US005805113A

United States Patent [19]

Ogino et al.

[11] Patent Number: 5,805,113

[45] Date of Patent: Sep. 8, 1998

[54] MULTIBAND ANTENNA RECEIVER SYSTEM WITH, LNA, AMP, COMBINER, VOLTAGE REGULATOR, SPLITTER, NOISE FILTER AND COMMON SINGLE FEEDER

[76] Inventors: Toshikazu Ogino; Hideo Yajima, both of c/o Mitsumi Electric Co., Ltd. Atsugi Operations Base of 1601, Sakai, Atsugi-shi, Kanagawa, Japan

[21] Appl. No.: 893,388

[22] Filed: Jul. 11, 1997

Related U.S. Application Data

[63] Continuation of Ser. No. 594,160, Jan. 31, 1996, abandoned.

[30] Foreign Application Priority Data

Jan. 31, 1995 [JP] Japan ..... 7-014439
Jan. 31, 1995 [JP] Japan ..... 7-034420

[51] Int. Cl.[6] ..... H01Q 1/32; H01Q 5/01

[52] U.S. Cl. ..... 343/713; 343/725; 343/853; 343/858; 455/276.1; 455/277.1; 455/278.1

[58] Field of Search ..... 343/711, 713, 343/858, 725, 873, 853; 455/272, 273, 276.1, 277.1, 277.2, 278.1; H01Q 1/32, 5/00, 5/01

[56] References Cited

U.S. PATENT DOCUMENTS

| | | | |
|---|---|---|---|
| 4,141,016 | 2/1979 | Nelson | 343/858 |
| 4,760,402 | 7/1988 | Mizuno et al. | 343/713 |
| 5,177,493 | 1/1993 | Kawamura | 343/713 |
| 5,317,327 | 5/1994 | Piole | 343/725 |
| 5,650,792 | 7/1997 | Moore et al. | 343/725 |

FOREIGN PATENT DOCUMENTS

| | | | |
|---|---|---|---|
| 60-260205 | 12/1985 | Japan | 343/713 |
| 3-34306 | 4/1991 | Japan . | |
| 3-34308 | 4/1991 | Japan . | |
| 3-343307 | 4/1991 | Japan . | |
| 6-29711 | 2/1994 | Japan . | |
| 7-99405 | 4/1995 | Japan . | |
| 2165700 | 4/1986 | United Kingdom | 343/700 MS |

*Primary Examiner*—Michael C. Wimer
*Attorney, Agent, or Firm*—Patents & TMS; Brian M. Mattson

[57] ABSTRACT

An antenna unit and a receiver having such an antenna are disclosed. The antenna includes an antenna body; a first antenna provided on the antenna body for receiving signals transmitted from satellites; at least one second antenna provided on the antenna body for receiving signals transmitted over the earth; a mixer provided in the antenna body for mixing or combining the signals received by the first and second antennas to output the mixed signals as a single output. Further, the receiver includes, in addition to these elements of the antenna unit, a signal separating device for separating the mixed signals into the signal received by the first antenna and the signal received by the second antenna, respectively and then outputting them; and a single cable which connects the mixer and the single separating device to supply the mixed signals thereto. Accordingly, since the antenna unit is provided with the mixer which combines or mixes the received signals and outputs the mixed signals as a single output, only one cable it required to connect the antenna unit to the signal separating device, thereby enabling to reduce the number of cables used for connecting respective antennas with respective corresponding electrical devices.

9 Claims, 9 Drawing Sheets

MULTIBAND ANTENNA RECEIVER SYSTEM WITH, LNA, AMP, COMBINER, VOLTAGE REGULATOR, SPLITTER, NOISE FILTER AND COMMON SINGLE FEEDER

This is a continuation of application Ser. No. 08/594,160 filed Jan. 31, 1996 abandoned.

BACKGROUND OF THE INVENTION

1. Field of the Invention

The present invention relates to an antenna unit, and in particular to an antenna unit and a receiver equipped with the antenna unit which are adapted to be mounted on a vehicle.

2. Description of the Prior Art

Recently, various electrical devices, such as radios, televisions, radio telephones, car navigation devices (i.e., GPS devices) and the like, for receiving and transmitting information have been used in vehicles. In general, when such electrical devices are used in a vehicle, a separate exclusive-use antenna for each electrical device must be mounted on the vehicle to receive appropriate signals.

For example, in order to listen to an FM broadcast on a radio provided inside a vehicle, an exclusive-use FM broadcast signal receiving antenna (FM antenna) must be mounted on the vehicle. Likewise, in order to watch a television broadcast on a television provided inside a vehicle, an exclusive-use television broadcast signal receiving antenna (TV antenna) must be mounted on the vehicle.

Further, as explained above, radio telephone devices may be installed in vehicles. The radio telephone device is generally comprised of a radio telephone antenna and a radio telephone unit. Therefore, when such a radio telephone device is installed in a vehicle, an exclusive-use telephone antenna must be mounted on the vehicle.

Furthermore, when a GPS navigation device is installed in a vehicle, an exclusive-use GPS navigation device antenna (hereinafter, simply referred to as GPS antenna) for receiving signals transmitted from GPS satellites (GPS signals) must be mounted on the vehicle. In such a GPS navigation device, the GPS signals received by the GPS antenna are processed, and based on such processed GPS signals, a monitor provided inside the vehicle displays the current position of the vehicle. Namely, when such a GPS navigation device is installed in a vehicle, an exclusive-use GPS antenna only for receiving the GPS signals must be mounted on the vehicle. In this case, if an FM antenna is provided on a vehicle, it is possible to obtain differential GPS data through a FM multichannels broadcast.

As described above, in the case where a plurality of various information-receiving electrical devices are used in a vehicle, it is necessary to mount a separate exclusive-use antenna for each device, and such antennas must be mounted at different locations from each other on the vehicle. As a result, the number of antennas that must be mounted on the vehicle increases in direct proportion to the number of information-receiving electrical devices used in the vehicle. Furthermore, because this makes it necessary to employ a separate cable to connect each antenna with its corresponding electrical device, the number of cables needed increases and this leads to a complex construction and wiring.

Moreover, such arrangement of a plurality of different antennas mounted at different locations results in a lowering of signal receiving level due to radio interference caused by such arrangement of antennas.

SUMMARY OF THE INVENTION

The present invention has been made in view of the problems which are caused when a plurality of information-receiving electrical devices such as radio receivers, televisions, radio telephones and GPS navigation devices and the like each having an individual exclusive-use antenna are mounted on a vehicle. Accordingly, a main object of the present invention is to provide an antenna unit and a receiver equipped with such an antenna unit which make it possible to mount a plurality of antennas for such electrical devices at one location on a vehicle.

Another object of the present invention is to provide an antenna unit and a receiver equipped with such an antenna unit which make it possible to reduce the number of cables used for connecting individual antennas to respective corresponding devices when these devices are mounted on a vehicle.

Yet another object of the present invention is to provide an antenna unit and a receiver equipped with such an antenna unit which enable to avoid occurrence of radio interference between a plurality of antennas of various electric devices.

Other object of the present invention is to provide an antenna unit in which an antenna thereof can be easily housed therein and taken out therefrom, and which is hardly affected by air resistance or wind pressure when a vehicle provided with the antenna unit is running.

In order to achieve these objects, the antenna unit according to the present invention comprises an antenna body; a first antenna provided on the antenna body for receiving signals transmitted from satellites; at least one second antenna provided on the antenna body for receiving signals transmitted over the earth; combining means provided in the antenna body for combining the signals received by the first and second antennas to output the combined signals as a single output.

According to the antenna unit having the above structure, the following advantages are realized. Namely, since a plurality of different types of antennas are provided in one antenna unit, it facilitates attachment of these antennas to a vehicle. Further, according to the present invention, when a signal processing circuit used in the antenna unit is designed, it can be made by taking the characters of the respective antennas into account. Therefore, it is possible to design the circuit and the arrangement of the antennas such that no radio interference would occur between the antennas, thereby being able to avoid a lowering of signal receiving level which would be caused by radio interference, as compared with the prior art in which a plurality of different types of antennas are mounted in many locations on a vehicle at random. Furthermore, according to the present invention, since different types of received signals are outputted as a single output by the combining means such as a mixer, it is sufficient to have only one cable. As a result, the number of cables needed for connecting the antennas to the respective devices can be reduced and therefore the wiring becomes simplified in comparison with the prior art. Moreover, total cost may be reduced as compared with the case where these antennas would be purchased separately.

Another aspect of the present invention is directed to a receiver which includes, in addition to the elements of the antenna unit of the present invention as described above, a signal separating means for separating the combined signals into the signal received by the first antenna and the signal received by the at least two antennas, respectively and then outputting them; and a single cable which connects the combining means and the signal separating means to supply the combined signals thereto.

Further, the other aspect of the present invention is directed to an antenna unit which comprises an antenna body to be removably attached to a vehicular body, a cover which is pivotally mounted to the antenna body and at least one antenna provided on the antenna body for receiving signals transmitted over the earth. The cover is pivotal between an open position in which the cover is raised above the antenna body and a closed position in which the cover is closed with respect to the antenna body. The at least one antenna is provided on the antenna body so as to be pivotal between a first position in which the antenna can be housed within the cover and a second position in which the antenna protrudes outside the cover to receive the signal. Further, the cover is constructed in such a way that the cover can be held in the closed position when the antenna is in the first position, the antenna can be pivoted from the first position to the second position when the cover is in the open position and the cover can be held in the closed position when the antenna is in the second position.

According to the antenna unit having the above structure, the cover can be closed and locked to the antenna body even if the rod antenna is taken out and placed its second position (signal receiving position). Therefore, if a vehicle on which this antenna unit is mounted is running with the antenna being in the signal receiving position, the antenna unit is hardly affected by air resistance or wind pressure, thus resulting in less possibility that the antenna unit or antenna is damaged by the air resistance or wind pressure. Further, it is also possible to prevent the cover from being rattled due to wind pressure or vibration caused by the motion of the vehicle when it is running.

Further, since this antenna unit is hardly affected by air resistance or wind pressure as stated in the above, the antenna unit can be securely attached onto a roof of a vehicle or the like using an appropriate attachment means such as a magnet or the like. As a result, there is no need for preparing other attachment such as mounting brackets or for boring a hole in a vehicle body.

Other objects, structures and functions of the present invention will become more apparent when the following description of the preferred embodiments are considered together with the appended drawings.

DETAILED DESCRIPTION OF THE PREFERRED EMBODIMENTS

With reference to the drawings, a detailed description of the preferred embodiments will now be given below.

Figure 1:
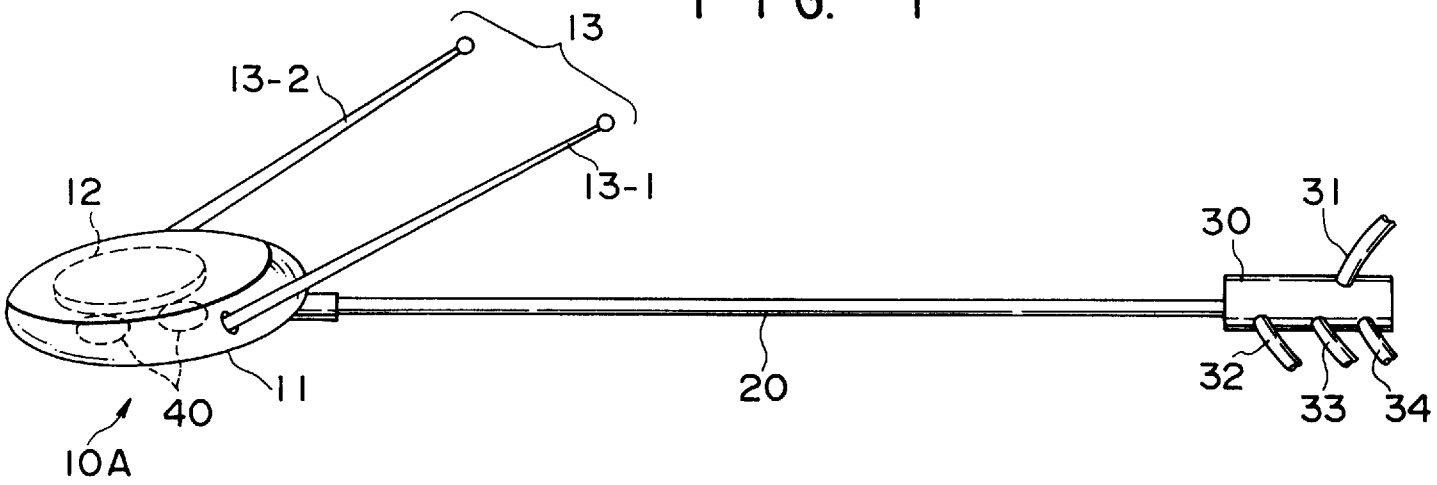
FIG. 1 is a perspective view which shows the overall structure of a receiver equipped with an antenna unit according to a first embodiment of the present invention, which is adapted to be mounted on the outside of a vehicle.

FIG. 1 shows a receiver which includes an antenna unit 10A according to the first embodiment of the present invention. The antenna unit 10A is connected to a signal separating device 30 via a single cable 20.

The antenna unit 10A shown in FIG. 1 is constructed into an unit which is adapted to be mounted on the outside of a vehicle, such as on the roof or trunk of the vehicle, for example. The antenna unit 10A has an antenna body 11 which includes a GPS antenna 12 for receiving GPS signals transmitted from GPS satellites and a combined television and FM signal receiving antenna 13 for receiving TV and FM signals (hereinafter simply referred to as a "TV/FM antenna"). Namely, the GPS antenna 12 and the TV/FM antenna are integrally provided in the antenna body 11. Further, in this embodiment, the TV/FM antenna 13 includes a first antenna 13-1 and a second antenna 13-2.

The antenna unit 10A constructed in this way is mounted to a vehicle at any location on the outside thereof, such as the roof or trunk, by a mounting means 40, such as a magnet or double-sided tape, provided on the bottom of the antenna body 11.

As will be described below, the antenna body 11 includes a combining means for combining the GPS signals received by the GPS antenna 12 and the TV and FM signals received by the TV/FM antenna 13. In this connection, the signals which are combined by the combining means form a single output which is supplied to the signal separating device 30 via the cable 20. As will be described below, the combining means is constructed from a mixer 113 of a signal processing circuit provided in the antenna body 11.

The signal separating device 30 includes a power terminal 31 for receiving a supply voltage, a GPS terminal 32 for outputting GPS signals, a TV terminal 33 for outputting TV signals, and a FM terminal 34 for outputting FM signals. Namely, in addition to supplying the supply voltage received at the power terminal 31 to the antenna unit 10A via the cable 20, the signal separating device 30 also serves to separate the combined signals fed from the mixer 113 into the GPS signals, the TV signals and the FM signals, respectively and then outputs them through the GPS terminal 32, the TV terminal 33 and the FM terminal 34, respectively. Such a signal separating device 30 is constructed using a branching filter or the like.

Figure 2:
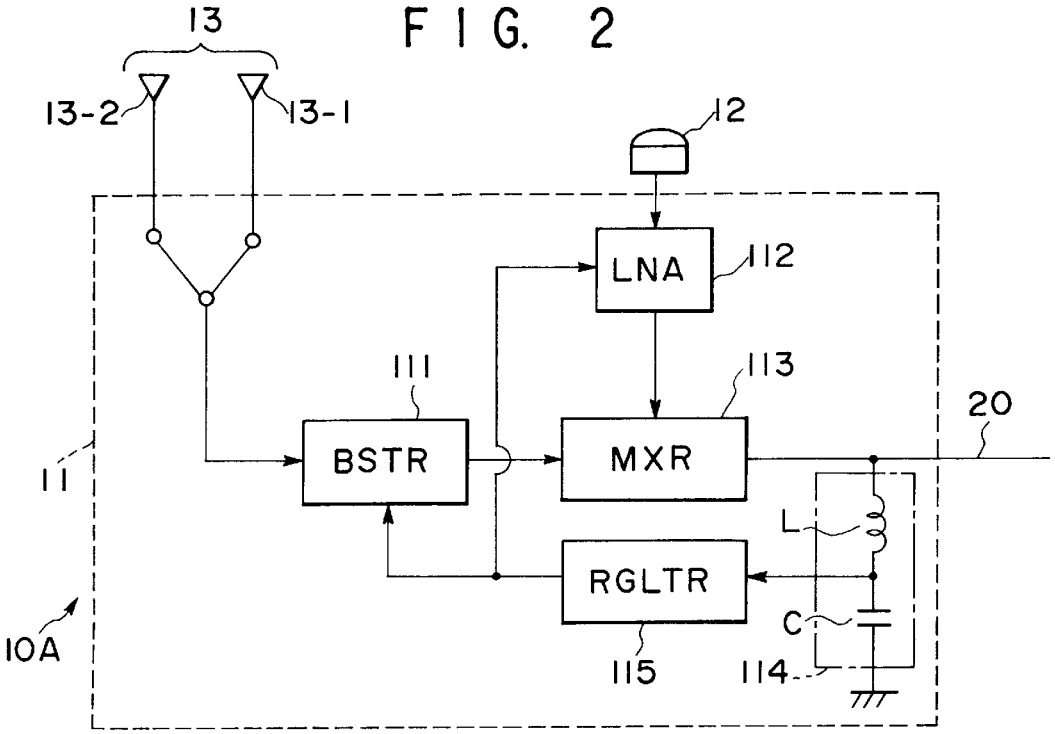
FIG. 2 is a block diagram which shows the structure of a signal processing circuit provided inside the antenna unit shown in FIG. 1.

Next, with reference to FIG. 2, a description of the construction of the signal processing circuit of the antenna unit 10A of the first embodiment will be given below.

The signal processing circuit of the antenna body 11 is generally composed of a booster 111, a low-noise amplifier 112 (hereinafter referred to as a "LNA 112"), the mixer 113, a noise filter 114 and a voltage regulator 115. The TV/FM antenna 13 is connected to the booster 111 and the GPS antenna is connected to the LNA 112. Further, the output of the booster 111 and the output of the LNA 112 are connected to the mixer 113, whereby signals obtained from the TV/FM antenna and the GPS antenna are combined or mixed to form a single output.

Namely, the mixer 113 constitutes the combining means for combining the GPS signals received by the GPS antenna 12 and the TV and FM signals received by the TV/FM antenna 13, whereby the mixer 113 is able to output a single output produced by combining such GPS signals and TV and FM signals. In this way, in the mixer 113, two very different frequency bands, namely TV and FM signals transmitted at a frequency of 30–300 MHz and GPS signals transmitted at a frequency of 3–30 GHz, are combined to form a single output. In this regard, the mixer 113 may be constructed from well-known circuits.

The noise filter 114 is constructed from a coil L and a condenser C which are connected in series, and thus constructed noise filter is connected between the cable 20 and a ground. Further, the noise filter 114 removes noise (in this case, GPS signals, TV signals and FM signals) added to the supply voltage in the cable 20 so as to produce a noise-free supply voltage which is then supplied to the voltage regulator 115.

The voltage regulator 115 supplies a prescribed voltage to the booster 111 and the LNA 112, respectively, for driving them. In other words, even though the supply voltage in the present embodiment fluctuates between 5V–8V, the voltage regulator 115 outputs a prescribed voltage, which is normally about 4.7V, to the booster 111 and the LNA 112.

In this way, because the GPS antenna 12 and the TV/FM antenna 13 are integrally provided in the antenna body 11, the antenna unit 10A according to the present embodiment makes it possible to incorporate a plurality of antennas in a single unit. As a result, there is no need to mount separate GPS, TV and FM antennas at different locations, as was done in the prior art, and this makes it easy to mount a plurality of antennas on a vehicle.

Furthermore, according to this embodiment, when a signal processing circuit used in the antenna unit 10A is designed, it can be made by taking the characters of the GPS antenna and the TV/FM antenna into account. Therefore, it is possible to design the circuit and the arrangement of these antennas such that no radio interference would occur between the antennas, thereby being able to avoid a lowering of signal receiving level which would be caused by radio interference, as compared with the prior art in which a plurality of different types of antennas are mounted in many locations on a vehicle at random.

Moreover, because each of the received signals is outputted through the single cable 20, there is no need to use separate cables for each of the antennas. As a result, it is possible to limit the number of cables to only a single cable, and this in turn greatly simplifies the wiring for the antennas.

Figure 3:
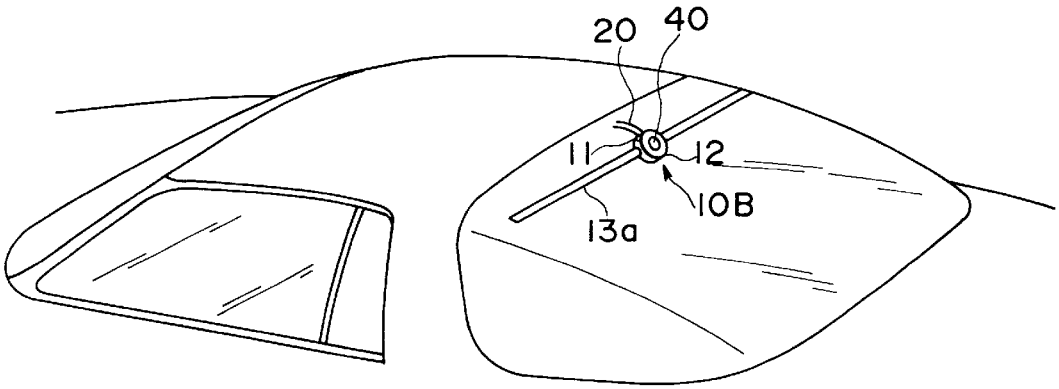
FIG. 3 is an illustration of an antenna unit according to a second embodiment of the present invention, in which the illustration shows the condition that the antenna unit is attached to the inside of a vehicle.

Next, FIG. 3 shows an antenna unit 10B according to the second embodiment of the present invention. In this embodiment, the antenna unit 10B is mounted on the inside of a vehicle. Now, in the same manner as was described above for the antenna unit 10A of the first embodiment, the antenna unit 10B of the second embodiment also has a GPS antenna 12 and a wire-shaped TV/FM antenna 13 integrally provided in an antenna body 11. In this connection, because the structure of the signal processing circuit of the antenna unit 10B of the second embodiment is the same as the circuit of the antenna unit 10A of the first embodiment shown in FIG. 2, a description of such signal processing circuit is omitted.

In this second embodiment, the antenna body 11 includes a mounting means 40, such as double-sided tape, a suction cup or the like. This mounting means 40 is used to attach the antenna body 11 to the inside surface of the rear wind of the vehicle, thereby the antenna unit 10B can be mounted inside the vehicle.

In the antenna unit 10B, GPS signals received by the GPS antenna 12 and TV and FM signals received by the TV/FM antenna 13*a* are combined by the mixer 113 after respectively passing through the LNA 112 and the booster 111 in the same manner as was described above for the first embodiment. The signals combined by the mixer 113 are then supplied to the signal separating device 30 via the single cable 20. Accordingly, the present embodiment also makes it possible to limit the number of cables to a single cable.

Figure 4:
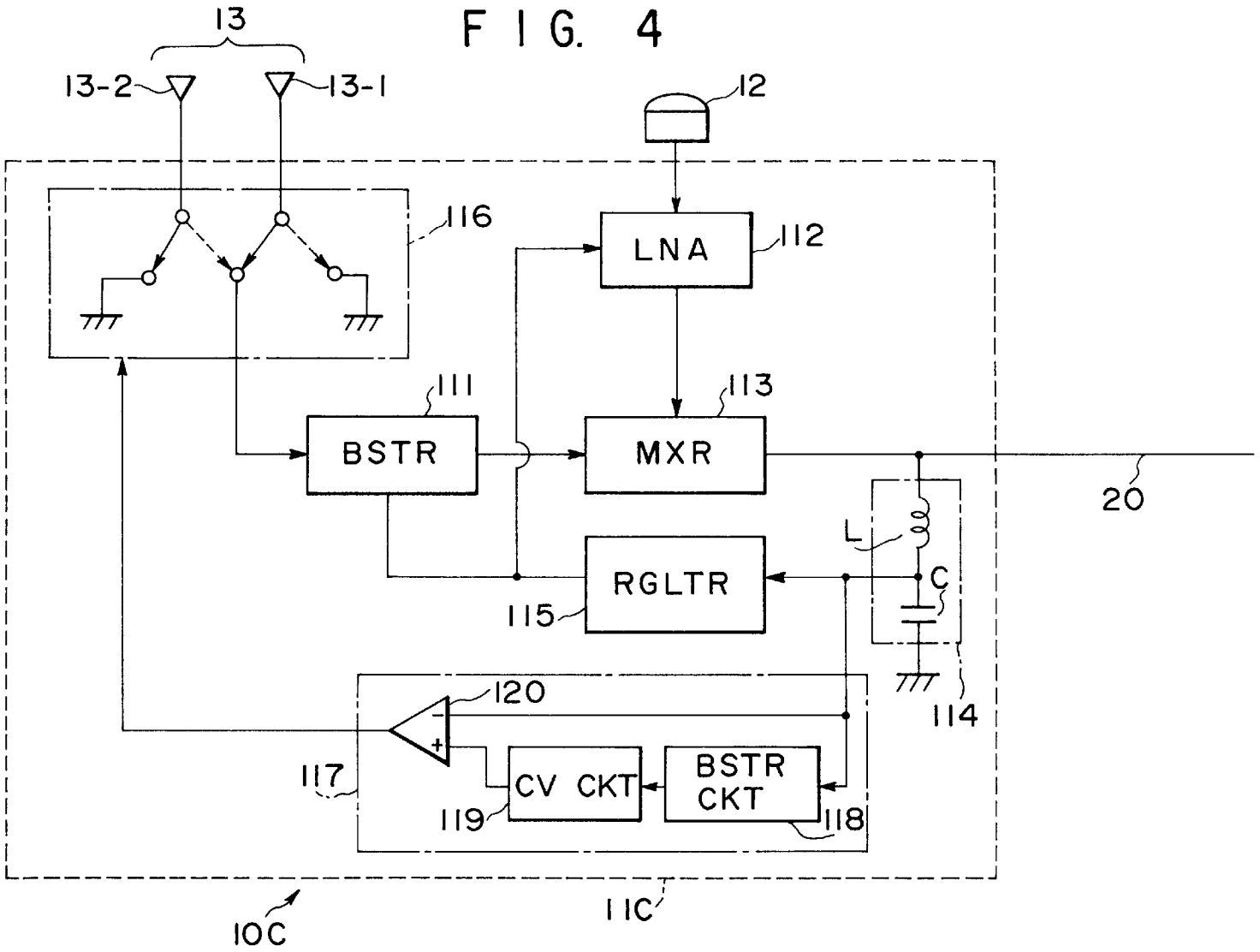
FIG. 4 is a block diagram which shows the structure of a signal processing circuit provided inside an antenna unit according to a third embodiment of the present invention.

FIG. 4 shows the structure of an antenna unit 10C according to the third embodiment of the present invention. In this embodiment, in order to reduce the fluctuations in FM signal reception which is likely to be caused due to motion of the vehicle, a diversity reception system using first and second antennas 13-1, 13-2 is employed to switch the diversity of the TV/FM antenna. Namely, as was described above, because the supply voltage fluctuates between 5V–8V, selection is made between the first antenna 13-1 and the second antenna 13-2 based on the value of such supply voltage, thereby enabling to receive an optimum signal.

Now, in this third embodiment, except for the antenna body 11 C (described hereinbelow) which is different from the antenna body 11 shown in FIGS. 1 and 2, the structure of the antenna unit 10C is the same as that of the antenna unit 10A shown in FIGS. 1 and 2. Namely, except for the addition of an diversity antenna switch 116 and a control signal generating circuit 117, the structure of the signal processing circuit of the antenna unit 10C is the same as that of the signal processing circuit of the antenna unit 10A shown in FIG. 2.

In more details, as shown in FIG. 4, in the signal processing circuit of the third embodiment, the diversity antenna switch 116 is provided between the booster 111 and the first and second antennas 13-1 and 13-2 of the TV/FM antenna 13. Further, the diversity antenna switch 116 selects one of the first and second antennas 13-1, 13-2 based on control signals from the control signal generating circuit 117 (described hereinbelow) and connects such selected antenna to the booster 111.

The control signal generating circuit 117 generates control signals based on the value of the supply voltage outputted from the noise filter 114 to the control signal generating circuit 117. Namely, as was explained above, because the supply voltage fluctuates between 5V–8V in the present embodiment, the control signal generating circuit 117 generates a logical low-level control signal to select the first antenna 13-1 when the supply voltage is greater than or equal to a prescribed voltage (e.g., 6V) and generates a logical high-level control signal to select the second antenna 13-2 when the supply voltage is below the prescribed voltage (e.g., 6V).

The control signal generating circuit 117 is constructed from a booster circuit 118, a constant-voltage circuit 119 and a comparator 120. The booster circuit 118 and the comparator 120 are supplied with supply voltage from the noise filter 114.

The booster circuit 118 boosts the supply voltage supplied from the noise filter 114, and then this boosted voltage is applied to the constant-voltage circuit 119. The constant-voltage circuit 119 receives the boosted voltage and outputs a reference voltage (e.g., 6V). Accordingly, the combination of the booster circuit 118 and the constant-voltage circuit 119 serves as a reference voltage generating circuit.

The comparator 120 compares the supply voltage supplied from the noise filter 114 with the reference voltage supplied from the constant-voltage circuit 119 and then outputs a control signal based on the results of such comparison. Namely, the comparator 120 outputs a logical low-level control signal when the supply voltage is greater than or equal to the reference voltage (e.g., 6V) and outputs a logical high-level control signal when the supply voltage is lower than the reference voltage (e.g., 6V).

Now, when a logical low-level control signal is outputted from the comparator 120, the diversity switch 116 carries out a switching operation to connect the first antenna 13-1 to the booster 111, as shown by the solid line in FIG. 4. On the other hand, when a logical high-level control signal is outputted from the comparator 120, the diversity switch 116 carries out a switching operation to connect the second antenna 13-2 to the booster 111, as shown by the dashed line in FIG. 4. In this way, a diversity switching is carried out.

Figure 5:
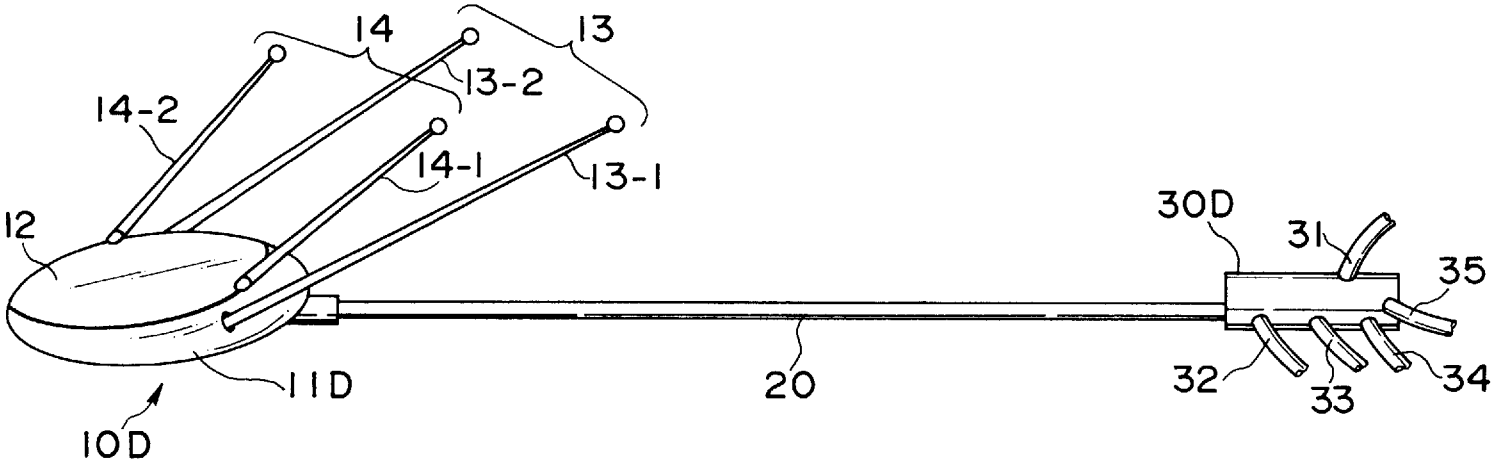
FIG. 5 is a perspective view which shows the overall structure of a receiver equipped with an antenna unit according to a fourth embodiment of the present invention.

Next, FIG. 5 shows a receiver which includes an antenna unit 10D according to the fourth embodiment of the present invention. In the same manner as was described above for the antenna unit 10A of the first embodiment, the antenna unit 10D is connected to a signal separating device 30D via a single cable 20.

Now, except for the integral provision of a telephone antenna 14 for a radio telephone in addition to the provision of a GPS antenna and a TV/FM antenna, the structure of the antenna unit 10D is the same as that of the antenna unit 10A of the first embodiment and the antenna unit 10C of the third embodiment. Namely, in a manner similar to that for the TV/FM antenna 13, the telephone antenna 14 is also comprised of a first antenna 14-1 and a second antenna 14-2. Further, except for the additional provision of a telephone terminal 35, the structure of the signal separating device 30D is the same as the signal separating device 30 shown in FIG. 1. Thus constructed signal separating device 30D is connected to a GPS processing device, a television, a radio, a telephone and the like (not shown in the drawings) through the terminals 32–35, respectively.

Further, in the same manner as was described above for the previous embodiments, the signal processing circuit provided in the antenna body 11D includes a mixer 113 for combining GPS signals received by the GPS antenna 12, TV and FM signals received by the TV/FM antenna and telephone reception signals received by the telephone antenna 14. Further, the signals combined by the mixer 113 are supplied to the signal separating device 30D via the single cable 20 in the same manner as was described above for the previous embodiments.

In addition to supplying the supply voltage received by the power terminal 31 to the antenna unit 10D via the cable 20, the signal separating device 30D separates the combined signals into the GPS signals, TV signals, FM signals and telephone reception signals, respectively, and outputs them from the GPS terminal 32, the TV terminal 33, the FM terminal 34 and the telephone terminal 35, respectively. Further, when telephone transmission signals which are inputted from the telephone terminal 35, the signal distribution device 30D sends such telephone transmission signals to the antenna unit 10D via the cable 20. When these telephone transmission signals are supplied to the antenna unit 10D, they are transmitted through the telephone antenna 14.

Now, by providing the antenna bodies 11D, 11C of the antenna units 10C, 10D of the third and fourth embodiments with a mounting means like that described for the antenna unit 10B of the second embodiment, it becomes possible to removably mount the antenna unit 10C and the antenna unit 10D inside or outside a vehicle.

Furthermore, even though the above embodiments were described for cases in which the antenna unit is mounted either outside or inside a vehicle, it is also possible to apply the present invention to a portable type antenna unit.

As described above, because the antenna unit according to any of the embodiments 1 through 4 has an antenna body which is integrally provided with a GPS antenna and at least one other antenna, it is possible to mount these different antennas at one location on a vehicle. Further, mounting operation of these antenna to a vehicle becomes very easy.

Furthermore, in comparison with the prior art in which a plurality of antennas are arranged on a vehicle at random, the antenna unit according to the present invention can be made resistant to radio interference between the various antennas, since a signal processing circuit and antenna arrangement therefor can be designed by taking the characteristics of the respective antennas into consideration.

Moreover, because the receiver according to the present invention uses a single cable to connect the antenna unit with the signal separating device, there is no need for the plurality of cables as used in the prior art. Furthermore, the use of a single cable greatly simplifies the wiring of the receiver.

Next, FIGS. 6–10 show an antenna unit 200 according to a fifth embodiment of the present invention. In this embodiment, the antenna unit 200 is to be mounted on the outside of a vehicle.

Figure 6:
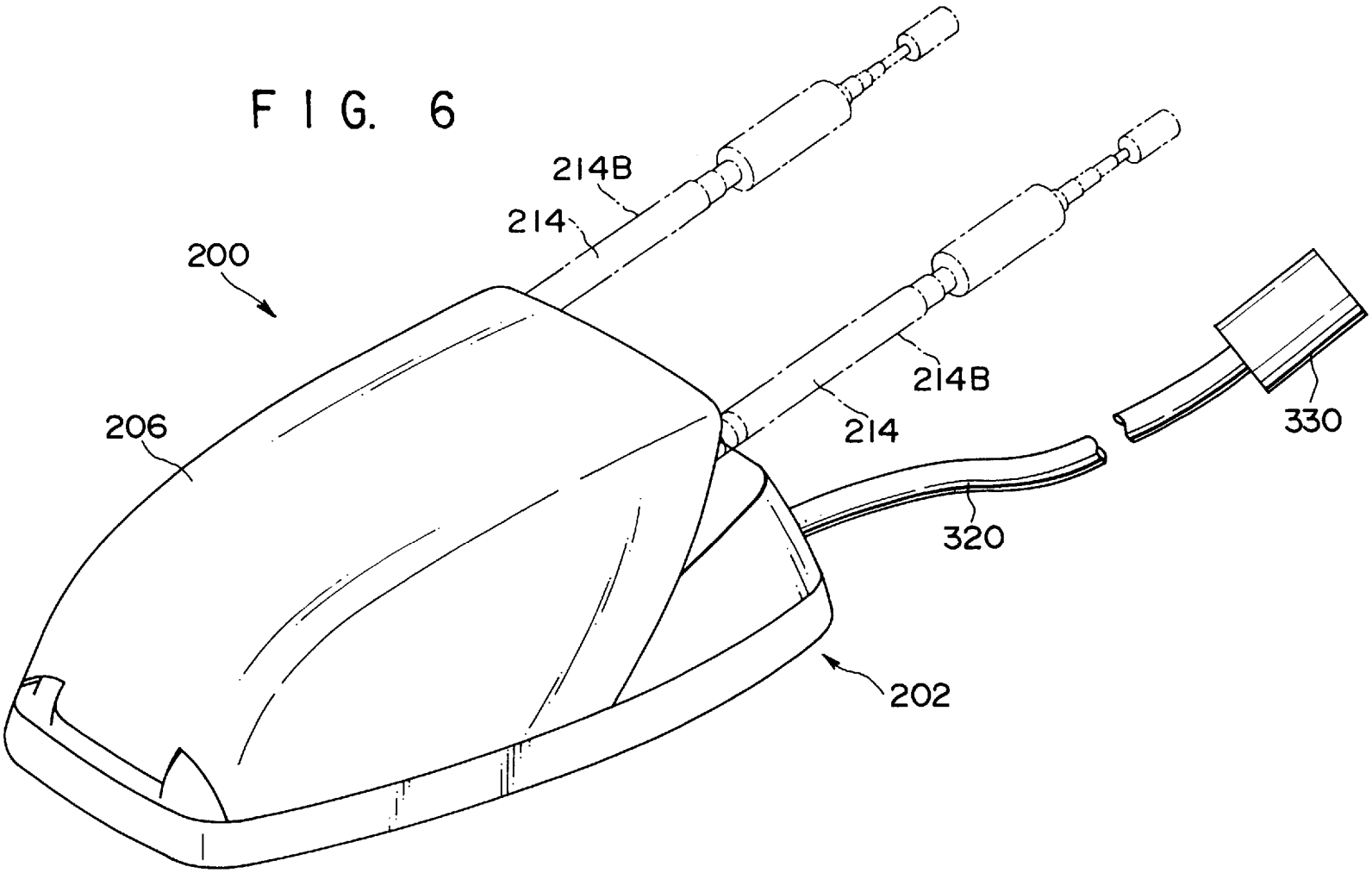
FIG. 6 is a perspective view which shows the entire structure of an antenna unit according to a fifth embodiment of the present invention.

FIG. 6 is a perspective view of the external structure of the antenna unit 200 according to the fifth embodiment of the present invention. As will be explained below, the antenna unit 200 is provided with a mounting means 235, such as a magnet or double-sided tape or the like, which makes it possible to freely attach and remove the antenna unit 200 from a desired location on the outside of a vehicle, such as the roof panel or the like.

Figure 7:
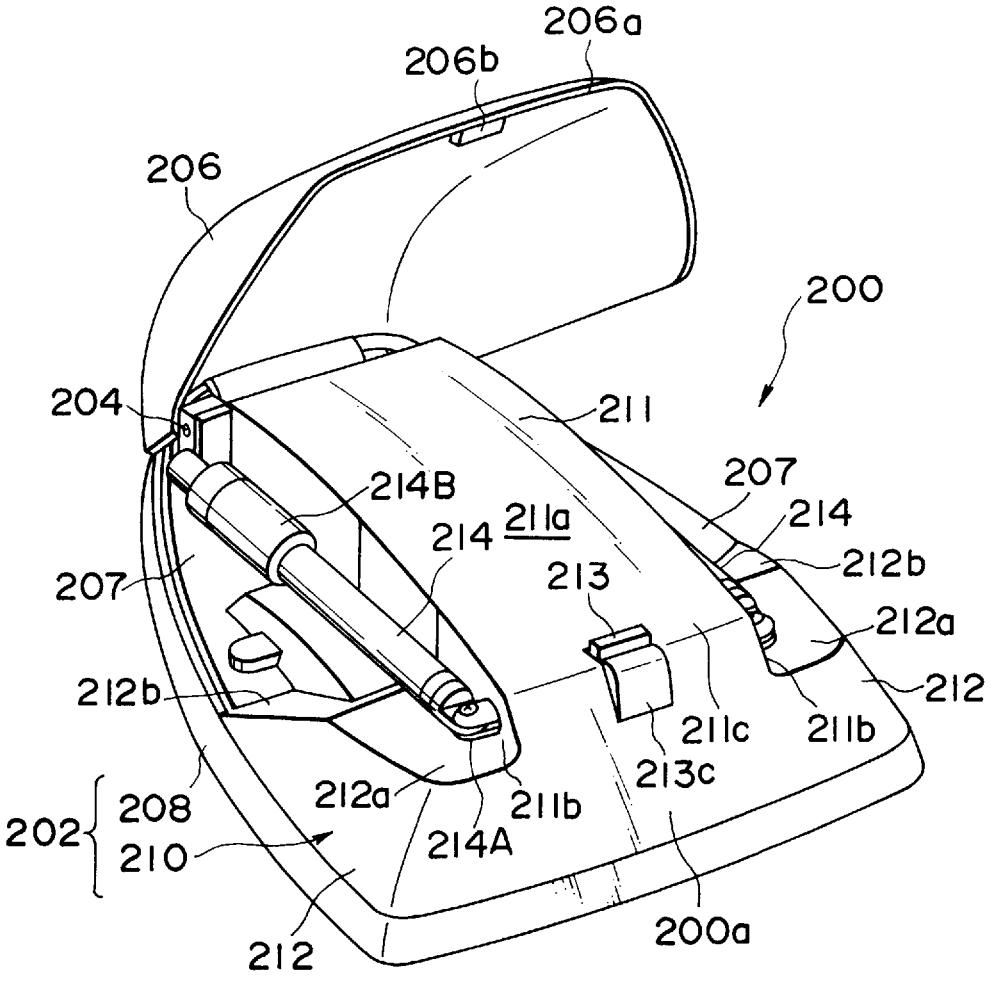
FIG. 7 is a perspective view which shows the condition that a cover of the antenna unit shown in FIG. 6 is opened.

Now, as shown in FIGS. 7 and 8, the antenna unit 200 is basically constructed from a main body 202 and a cover 206 which is equipped with a mating hinge that allows the cover 206 to be freely pivoted between an open position and a closed position via an axis 204 provided at the front end of the main body 202. Further, these elements are designed to give the entire antenna unit 200 a streamline shape.

As is shown in detail in FIG. 7, the main body 202 is constructed from a roughly trapezoidal shaped base 208 and an antenna storage and mounting portion 210 which is formed so as to rise above the upper surface of the base 208. As will be explained below, a pair of rod antennas 214 are attached to the antenna storage and mounting portion 210, and in addition to these rod antennas 214, a GPS antenna 232 is housed inside the antenna storage and mounting portion 210. Further, also housed within the antenna storage and mounting portion 210 is a circuit substrate 234 and the like which is provided with a signal processing circuit for processing signals received by such antennas.

The antenna storage and mounting portion 210 is basically formed from a rectangular central raised portion 211, which runs from the front of the base 208 toward the rear thereof, and left and right raised portions 212, 212 which are integrally formed with the left and right side surfaces 211*b* of the rear portion of the central raised portion 211, and in this way the entire storage and mounting portion 210 forms a roughly inverted T-shaped structure. Further, the rear surfaces of the central raised portion 211 and the left and right raised portions 212, 212 form a continuous surface which becomes a rear surface 200*a* or the antenna unit 200.

Further, each of the left and right raised portions 212 has an upper surface 212*a*, which lies one step below the upper surface 211*a* of the central raised portion 211, and a slanting surface 212*b* which runs from the front end of the upper surface 212*a* to the upper surface of the base 208. As is shown in FIG. 6, the slanting surface 212*b* of each raised portion 212 are formed so as to match with the left and right rear edges of the cover 206 when the cover 206 is closed.

Figure 10A:
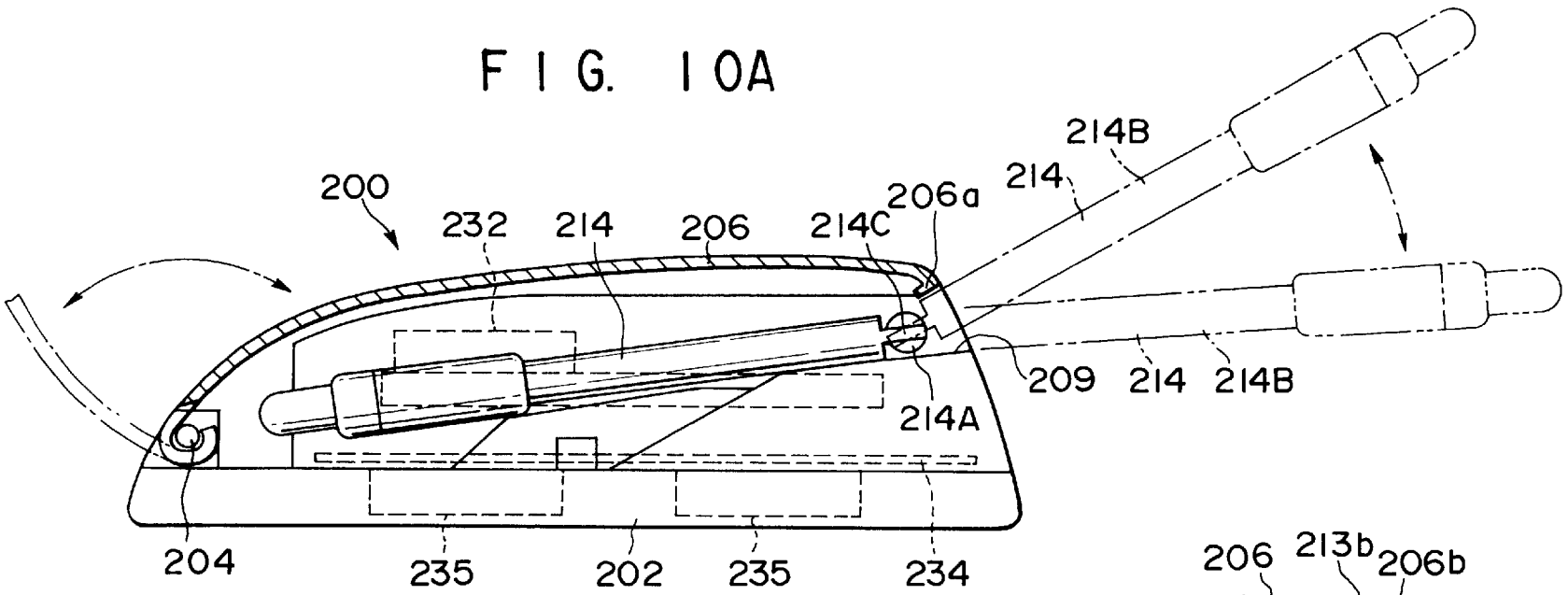
FIG. 10A is a cross-sectional view which shows the condition that the rod antennas of the antenna unit are in the signal receiving position (second position) and the cover is in the closed position.

Now, in the antenna unit 200 having the structure described above, when the cover 206 is closed with respect to the main body 202 by rotating the cover 206 from the open position shown in FIG. 7 to the closed position shown in FIG. 6, the left and right sides of the central raised portion 211 and the front portions of the left and right raised portions 212, 212 form a pair of left and right rod antenna storage spaces 207, 207 within the cover 206. Further, as shown in FIG. 10A, when the cover 206 is in the closed state, the top surfaces 212*a,* 212*a* of the left and right raised portions 212, 212, the rear portions of the left and right side surfaces 211*b*, 211*b* of the central raised portion 211, and the rear edge 206*a* of the cover 206 form prescribed left and right antenna protrusion spaces 209, 209, respectively, in the rear portion of the antenna unit.

Figure 8A:
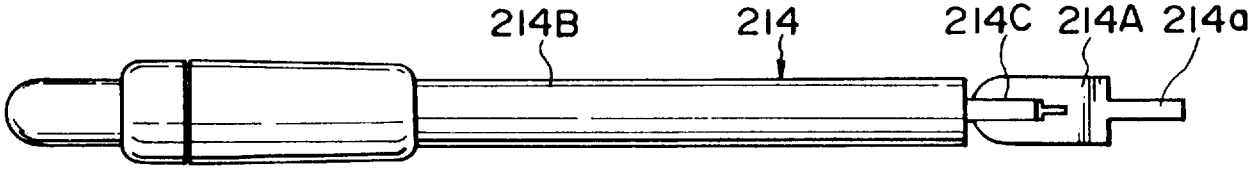
FIG. 8A is a side view which shows a rod antenna of the antenna unit of the fifth embodiment.
Figure 8B:
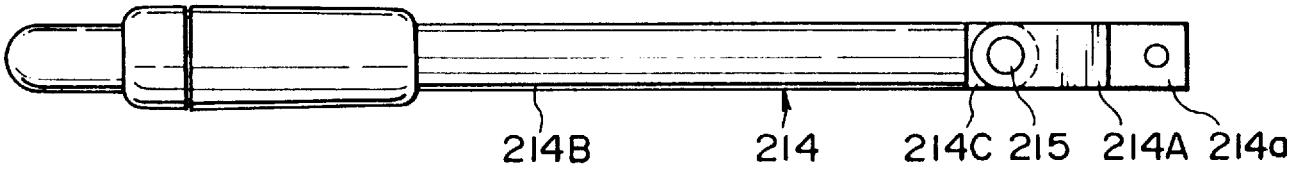
FIG. 8B is a top plan view of the same rod antenna.
Figure 9:
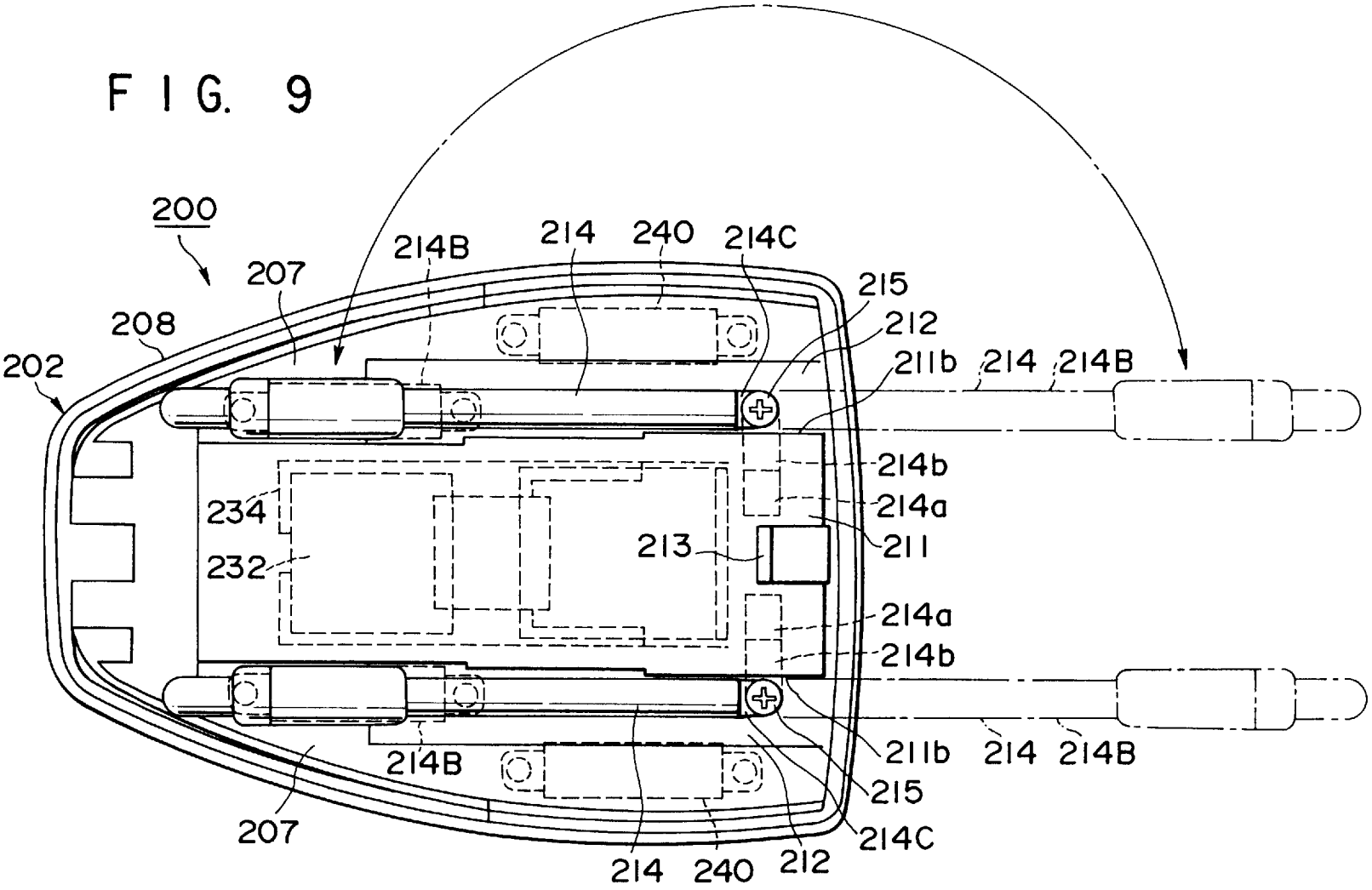
FIG. 9 is a top plan view of the antenna unit of the fifth embodiment, in which the cover is removed.

As is shown in FIG. 7, the rod antennas 214, 214 are attached to the rear portions of the left and right side surfaces 211*b*, 211*b* of the central raised portion 211. In more details, as is shown in FIGS. 8A and 8B, each of the rod antennas 214 is constructed from a base end mounting portion 214A, which is attached to the main body 202 of the antenna unit 200 so as to be rotatable thereto, and a telescopic antenna body 214B which is connected to the base end mounting portion 214A so as to be rotatable about an axis 215.

In more details, the base end mounting portion 214A has a connecting portion 214*b* and a base end flat portion 214*a* which is integrally formed at one end of the connecting portion 214*b*. Further, a connecting groove is formed in the axial direction in the other end of the connecting portion 214*b*. On the other hand, a flat portion 214*c* to be fitted into the connecting groove of the base end mounting portion 214A is formed at the base end of the antenna body 214B. This flat portion 214*c* is fitted into such connecting groove and it is rotatably coupled with the base end mounting portion 214A through the axis 215. As a result, the antenna body 214B is rotatable about the axis 215 with respect to the base end mounting portion 214A.

The rod antennas 214 constructed in this way are attached via the base end flat portions 214*a* of the base end mounting portions 214A to sockets (not shown in the drawings) provided in the rear portions of each of the left and right side surfaces 211*b* of the central raised portion 211 of the main body 202 so as to be rotatable thereto.

As a result, such sockets make it possible for the base end mounting portion 214A of each rod antenna 214 to rotate about the axial thereof with respect to the main body 202 of the antenna unit 200. Further, as stated in the above, the antenna body 214B of each rod antenna 214 can be rotated about the axis 215 with respect to the base end mounting portion 214A which is mounted to the main body 202. Therefore, each of the rod antennas 214 is pivotal between the antenna storage position (first position) shown in FIG. 7, in which the rod antenna 214 is housed within the antenna housing space 7, and the signal receiving position (second position) shown by the dotted line in FIGS. 6 and 9, which is located at 180 degrees about the axis 215 from the antenna storage position.

Further, when the cover 206 is closed while the rod antennas 214, 214 are in their respective signal receiving positions, the rod antennas 214, 214 will protrude outside the antenna unit 200 by means of the antenna protrusion spaces 209, 209. As a result, even when the cover 206 is in the closed state, it is possible to have the rod antennas 214, 214 located in their respective signal receiving positions and, in such state, moved up and down about the axis of the respective base end mounting portion 214A, as shown by the dotted line in FIG. 10A. Further, when these rod antennas 214, 214 are in their respective signal receiving positions, they are used in an appropriate expanded or contracted state, as shown in FIG. 6.

Now, even though the rod antennas 214, 214 were described in the present embodiment as TV/FM antennas for receiving TV and FM signals, it is also possible for the rod antennas 214, 214 to serve as exclusive-use TV antennas or exclusive-use FM antennas. Further, it is also possible for these rod antennas 214, 214 to be replaced with radio telephone antennas for vehicles.

Furthermore, as shown in FIG. 7, in the antenna unit 200, there is provided a locking device for locking the cover 206 with the main body 202. Namely, the rear end portion 211*c* of the central raised portion 211 is provided with an engaging member 213 which is adapted to engage with an engaging protrusion 206*b* formed at the rear end edge of the cover 206 in order to lock the cover 206 to the main body 202.

Figure 10B:
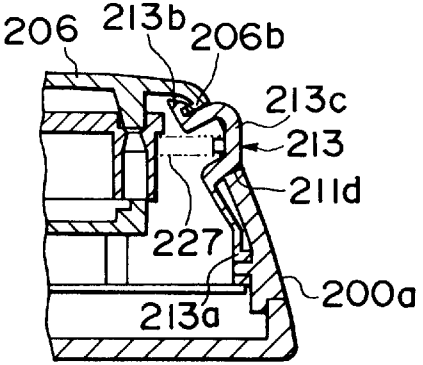
FIG. 10B is a cross-sectional view of a locking device provided in the antenna unit for holding the cover in the closed state.

Namely, as shown in Fig. 10B, the engaging protrusion 206*b* is provided at the rear end edge of the cover 206 so as to protrude inward, and the engaging member 213, which is made from an flexible strip, is provided inside the rear surface of the central raised portion 211. The engaging member 213 has a lower end 213*a,* which is fixed inside the rear surface of the central raised portion 211, and a hook 213*b* formed at an upper end portion thereof for engaging with the engaging protrusion 206*b* of the cover 206. Further, the engaging member 213 has a roughly U-shaped operating portion 213*c* formed slightly below the hook 213*b* so as to protrude outwards from an opening 211*d* formed in the rear end portion 211*c* of the central raised portion 211. Furthermore, the operating portion 213*c* is forced to protrude outwards from the opening 211*d* by a biasing means 227, such as a spring of the like, in order to enable the hook 213*b* to engage with the engaging protrusion 206*b* of the cover 206.

As a result, when the cover 206 is in the closed state, the flexible hook 213*b* engages with the engaging protrusion 206*b* of the cover 206 and is held in such engaged state by the biasing force of the biasing means 227, whereby it becomes possible to maintain the cover 206 in such closed state. On the other hand, when the cover 206 is to be opened, the operating portion 213*c* is pushed from the outside to release the hook 213*b* from its engaged state with the engaging protrusion 206*b* of the cover 206.

As a result, by providing such engaging means to reliably lock the cover 206 to the main body 202, it is possible to prevent the cover 206 from being opened by wind pressure when the vehicle to which the antenna unit 200 is attached is running. Furthermore, such simple arrangement also makes it possible to prevent the cover and the antennas of the antenna unit 200 from being damaged and prevent the cover 206 from rattling due to vibrations caused by the motion of the vehicle.

Further, as shown in FIG. 10A, in the antenna unit 200 according to the present embodiment, the mounting means 235 is provided on the bottom surface of the main body 202 in order to enable the antenna unit 200 to be attached to any desired location on the outside of a vehicle, such as the roof or the like. The mounting means 235 may employ one or more magnets, double-sided tape or any other fixing means that enables the antenna unit 200 to be fixed to the outside of the vehicle.

Next, a description of the method of using the antenna unit 200 according to the present embodiment will be given below.

First, in the case where the vehicle is not being used, or in the case where the electrical devices connected to such antennas are not intended to be used when the vehicle is running, the rod antennas 214, 214 are rotated to their respective storage positions, and in this state the cover 206 is closed with respect to the main body 202 and is locked in place by the engagement of the engaging member 213 with the engaging protrusion 206*b* of the cover 206. Furthermore, in the case where only a car navigation device is to be used, namely in the case where the antenna unit 200 is to be used only as a GPS antenna, the cover 206 is kept in such closed state while the antenna unit 200 is used to receive GPS signals.

On the other hand, in the case where a television or radio is to be operated within the vehicle, namely in the case where the antenna unit 200 is to be used as a TV/FM antenna, the following steps are carried out. First, the operating portion 213*c* of the engaging member 213 is pushed inwards from the outside of the main body 202 to release the engagement between the hook 213*b* and the engaging protrusion 206*b* of the cover 206, and then the cover 206 is rotated forwards to an open state. Next, the rod antennas 214, 214, which are in their respective storage positions, are rotated 180 degrees in the horizontal direction about their respective axis 215, 215 in order to position the rod antennas 214, 214 at their respective signal receiving positions, as shown by the dashed lines in FIG. 9. With the rod antennas 214, 214 in this state, the tip ends of the antenna bodies 214B are rotated upwards about the axis of their respective base end mounting portions 214A to position the rod antennas at upper signal receiving positions, as shown by the dashed lines in FIG. 10A. Next, while keeping the rod antennas 214, 214 in such raised positions, the cover 206 is rotated in the opposite direction to close the cover 206, and then the cover 206 is locked in such closed state by engaging the hook 213*b* of the engaging member 213 with the engaging protrusion 206*b* of the cover 206.

In this way, in the present embodiment, it is possible to close the cover 206 even when the rod antennas 214, 214 are arranged in their respective signal receiving positions. Accordingly, the antenna unit 200 will not be affected by strong wind pressure or air resistance even when the rod antennas 214, 214 are in their respective signal receiving positions while the vehicle is running. Further, because the antenna unit 200 employs a cover locking means, it is also possible to prevent the cover 206 from rattling due to vibrations caused by motion of the vehicle.

Furthermore, because the effects of wind pressure and air resistance while the vehicle is running are reduced, a reliable holding force can be achieved with simple mounting means 235 such as a magnet or the like. In this way, because the antenna unit 200 can easily be mounted onto a vehicle using a simple mounting means as described above, there is no need to use a mounting bracket or the like or to bore a hole in a vehicle body.

Moreover, the shape of the cover 206 is not limited to the shape shown in the drawings. Instead, the cover 206 may be formed with any suitable shape that makes it possible to reduce the wind pressure and air resistance while the vehicle is running.

Furthermore, by eliminating the GPS antenna from the antenna unit of the fifth embodiment, it is possible to construct an antenna unit which is equipped with only TV/FM rod antennas. Further, as shown by the dotted line in FIG. 9, a pair of radio telephone antennas 240 for use with a radio telephone may be additionally provided in the antenna storage spaces 207.

In this fifth embodiment, if a GPS, TV/FM and radio antennas are integrally provided in the antenna unit 200, it is possible to employ the same signal processing circuit (not shown in FIGS. 6–10) used in the first, third and fourth embodiments. Accordingly, as shown in FIG. 6, the signals from the plurality of antennas are combined by a mixer and sent to a signal distribution device 330 via a single cable 320. Thus, the antenna unit of the fifth embodiment also makes it possible to reduce the number of cables and simplify the wiring of these antennas.

Finally, it is to be understood that the present invention is in no way limited to the above-described embodiments and that many changes and additions may be made thereto within a scope of the present invention defined by the following claims.

What is claimed is:

1. A receiver apparatus comprising:

an antenna body;

a first antenna provided on said antenna body for receiving signals from satellites;

at least one second antenna provided on said antenna body separately from said first antenna for receiving signals transmitted over the earth, the signals having a different frequency band from that of the signals to be received by said first antenna;

a low noise amplifier provided in the antenna body for amplifying the received signals by said first antenna;

a booster provided in the antenna body for amplifying the received signals by said second antenna;

a mixer provided in said antenna body for combining the signals supplied from said first antenna through said low noise amplifier and the signals supplied from second antenna through said booster to output the combined signals as a single output;

a voltage regulator provided in said antenna body for supplying a predetermined voltage to said low noise amplifier and said booster, respectively, for driving them;

means for separating the combined signals into the signals received by said first antenna and the signals received by said second antenna, respectively, and then feeding the signals into respective signal receiving units, said separating means being provided separately from said antenna body;

a single cable which connects said combining means and said separating means to supply the combined signals to said separating means; and a noise filter connected to said single cable for acquiring a supply voltage from which a noise is removed and then supplying such noise-free supply voltage to said voltage regulator.

2. The receiver apparatus as claimed in claim 1 wherein said first antenna is a GPS antenna for receiving signals transmitted from GPS satellites, said second antenna includes a TV/FM antenna for receiving TV and FM signals, said combining means is adapted to combine the signals received by said GPS antenna and said TV/FM antenna to output the combined signals as a single output, and said separating means has a GPS terminal, a TV terminal and an FM terminal wherein said separating means receives the combined signals through said cable, and then separates the combined signals into the GPS signals, the TV signals and the FM signals, respectively, and output them through the GPS terminal, the TV terminal and the FM terminal, respectively.

3. The received apparatus as claimed in claim 2 wherein said TV/FM antenna has first and second antennas and said separating means further includes a power supply terminal from which a supply voltage is supplied wherein said antenna unit further comprises switching means for selecting either of said first or second antenna for signal reception on the basis of the value of the supplied voltage.

4. The receiver apparatus device as claimed in claim 3 wherein said first antenna is a GPS antenna for receiving signals transmitted from GPS satellites, said second antenna including a TV/FM antenna for receiving TV and FM signals and a radio telephone antenna for receiving and transmitting radio telephone signals, said combining means is adapted to combine the signals received by said GPS antenna, said TV/FM antenna and said radio telephone antenna to output such combined signals as a single output through said cable, and said separating means has a GPS terminal, a TV terminal, an FM terminal and a radio telephone terminal wherein said separating means receives the combined signals from said combining means through said cable, and then separates the combined signals into the GPS signals, the TV signals, the FM signals and the radio telephone signals, respectively, and outputs them through said GPS terminal, said TV terminal, said FM terminal and said radio telephone terminal, respectively.

5. The receiver apparatus as claimed in claim 1 wherein said noise filter is connected between the single cable and the ground and said noise filter is composed of a coil and a capacitor which are connected in Series.

6. The receiver apparatus as claimed in claim 5 wherein said voltage regulator is connected to said noise filter at a point between said coil and said capacitor.

7. The receiver apparatus as claimed in claim 1 wherein the supply voltage varies between predetermined voltage values and said voltage regulator always produces a constant voltage.

8. The receiver apparatus as claimed in claim 1 wherein said receiver apparatus is used for a vehicle in which said antenna body is adapted to be mounted on a desired position of a vehicle and said separating means is provided on a position in the vehicle which is away from the antenna body.

9. The receiver apparatus as claimed in claim 8 further comprising:

mounting means provided on said antenna body for mounting the antenna body to the desired position of the vehicle.

* * * * *

UNITED STATES PATENT AND TRADEMARK OFFICE

CERTIFICATE OF CORRECTION

PATENT NO. : 5,805,113

DATED : Sep. 8, 1998

INVENTOR(S) : Ogino et al.

It is certified that error appears in the above-indentified patent and that said Letters Patent is hereby corrected as shown below:

IN THE TITLE: After "WITH", delete ",". and col. 1, line 2

IN THE REFERENCES CITED, FOREIGN PATENT DOCUMENTS:

Replace "3-343307" with--3-34307--.

At Column 14, line 11, replace "Series" with --series--.

Signed and Sealed this

Seventh Day of March, 2000

*Attest:*

*Attesting Officer*

Q. TODD DICKINSON

*Commissioner of Patents and Trademarks*